US008807562B2

(12) United States Patent
Yamaguchi

(10) Patent No.: US 8,807,562 B2
(45) Date of Patent: Aug. 19, 2014

(54) SHEET CONVEYING APPARATUS AND IMAGE FORMING APPARATUS

(71) Applicant: Canon Kabushiki Kaisha, Tokyo (JP)

(72) Inventor: Yoshimasu Yamaguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/803,869

(22) Filed: Mar. 14, 2013

(65) Prior Publication Data

US 2013/0285318 A1 Oct. 31, 2013

(30) Foreign Application Priority Data

Apr. 26, 2012 (JP) ..... 2012-101865

(51) Int. Cl.

| | |
|---|---|
| ***B65H 5/02*** | (2006.01) |
| ***B41J 13/00*** | (2006.01) |
| ***B65H 29/12*** | (2006.01) |
| ***B65H 5/06*** | (2006.01) |
| ***B41J 13/02*** | (2006.01) |

(52) U.S. Cl.

CPC ..... *B41J 13/00* (2013.01); *B65H 29/125* (2013.01); *B65H 5/062* (2013.01); *B65H 2402/521* (2013.01); *B65H 2402/541* (2013.01); *B41J 13/025* (2013.01)

USPC ..... 271/273; 271/274

(58) Field of Classification Search

CPC .. B65H 5/062; B65H 29/125; B65H 2402/52; B65H 2402/521; B65H 2402/54; B65H 2402/541

USPC ..... 271/273, 274, 314

See application file for complete search history.

(56) References Cited

U.S. PATENT DOCUMENTS

| | | | | |
|---|---|---|---|---|
| 4,640,409 | A * | 2/1987 | Holtman | 198/624 |
| 6,336,629 | B1 * | 1/2002 | Carter et al. | 271/274 |
| 6,857,631 | B2 * | 2/2005 | Morrison et al. | 271/274 |
| 7,080,836 | B2 * | 7/2006 | Hamada et al. | 271/274 |
| 2002/0084580 | A1 * | 7/2002 | Shiau | 271/272 |
| 2006/0083547 | A1 * | 4/2006 | Otaka | 399/124 |
| 2007/0069456 | A1 * | 3/2007 | Jeong | 271/272 |
| 2008/0036141 | A1 * | 2/2008 | Liu et al. | 271/274 |

FOREIGN PATENT DOCUMENTS

| | | |
|---|---|---|
| JP | 11-143155 A | 5/1999 |
| JP | 2008-170825 A | 7/2008 |
| JP | 2008-213982 A | 9/2008 |

* cited by examiner

*Primary Examiner* — David H Bollinger

(74) *Attorney, Agent, or Firm* — Fitzpatrick, Cella, Harper & Scinto

(57) ABSTRACT

A sheet conveying apparatus comprising: a follower rotating member that is pressed to a conveying rotating member and rotates in a following manner; a bearing that movably supports the follower rotating member to be rotatable; a pressing portion that applies a force to the bearing to press the follower rotating member to the conveying rotating member; and a wire spring that includes both ends locked to locking portions and a middle abutted to the bearing and holds the bearing against a pressing force of the pressing portion.

17 Claims, 13 Drawing Sheets

SHEET CONVEYING APPARATUS AND IMAGE FORMING APPARATUS

BACKGROUND OF THE INVENTION

1. Field of the Invention

The present invention relates to a sheet conveying apparatus provided in an image forming apparatus such as a copying machine or a printer.

2. Description of the Related Art

As an image forming apparatus according to the related art, Japanese Patent Laid-Open No. 11-143155 discloses an image forming apparatus having a configuration in which a plate spring member applies a force to a conveying follower roller facing a conveying driving roller.

Japanese Patent Laid-Open No. 2008-213982 discloses a configuration in which a bearing is provided with a boss and a wound spring is mounted on the boss to apply a force to a roller.

Japanese Patent Laid-Open No. 2008-170825 discloses a configuration in which an axial portion of an inverting roller is inserted into an insertion groove in which the upper side of a bearing is opened and the upper end opening portion of the insertion groove is blocked with a dustproof sheet.

In Japanese Patent Laid-Open No. 11-143155, when a conveying follower roller is detached to perform maintenance or repair, a plate spring member is removed in a positional relation among a guide plate, the conveying follower roller, and the plate spring member, and then the conveying follower roller is detached. Therefore, when the conveying follower roller is installed on the inside of an exterior cover, the exterior cover has to be detached and the guide plate has to be detached in order to detach the conveying follower roller. Therefore, there is a problem that an extensive disassembly operation is performed.

In Japanese Patent Laid-Open No. 2008-213982, since the wound spring is mounted on the boss installed in the bearing of the roller, the boss contributes to stability of the applied force generated by the wound spring. The semicircular bearing receiving an axial portion of the roller receives an impact caused when the front ends of various sheets with different thicknesses passing through a sheet conveying path collide against a nip portion of a pair of rollers. Further, sheet powders produced from the sheets are deposited on a semicircular rubbing surface receiving the axial portion of the roller, and thus the bearing receives an impact caused when the front ends of the sheets collide against the depositions. Furthermore, the bearing receives an impact caused when the rear ends of the sheets are separated from the pair of rollers. Due to such influences, there is a probability that the axial portion of the roller is separated from the semicircular rubbing surface receiving the axial portion of the roller.

When one roller is installed on the inside of the exterior cover, there is a problem that a separate component is necessary to prevent the roller installed on the side of an apparatus body from being detached.

In Japanese Patent Laid-Open No. 2008-170825, the dustproof sheet is attached to prevent the axial portion from coming off or rattling. Thus, since a protruding object or the like is covered with the dustproof sheet and a sheet conveying surface becomes gentle, the curled front end of the sheet can be prevented from being caught. However, when the inverting roller or the axial portion is exchanged, the dustproof sheet is removed. When exchanging the inverting roller or the axial portion is completed, a glue of a pasting surface of the dustproof sheet is cleaned up, and thus a new dustproof sheet is re-covered. Therefore, a component cost may increase, and a sheet may be hooked due to an erroneous work for attaching the dustproof sheet in some cases since the work is not stable.

In order to solve the problems described above, the invention provides an image forming apparatus in which a work for mounting and detaching a follower rotating member facing a conveying rotating member can be easily performed and a sheet can be satisfactorily conveyed.

SUMMARY OF THE INVENTION

In order to accomplish the above-mentioned aspect, as a representative configuration, the present invention provides a sheet conveying apparatus comprising: a follower rotating member that is pressed to a conveying rotating member and rotates in a following manner; a bearing that movably supports the follower rotating member to be rotatable; a pressing portion that applies a force to the bearing to press the follower rotating member to the conveying rotating member; and a wire spring that includes both ends locked to locking portions and a middle abutted to the bearing and holds the bearing against a pressing force of the pressing portion.

Further features of the present invention will become apparent from the following description of exemplary embodiments with reference to the attached drawings.

DESCRIPTION OF THE EMBODIMENTS

An image forming apparatus including a sheet conveying apparatus according to an embodiment of the invention will be described in detail with reference to the drawings.

First Embodiment

First, the configuration of the image forming apparatus including the sheet conveying apparatus according to a first embodiment of the invention will be described with reference to FIGS. 1 to 11D.

Figure 1:
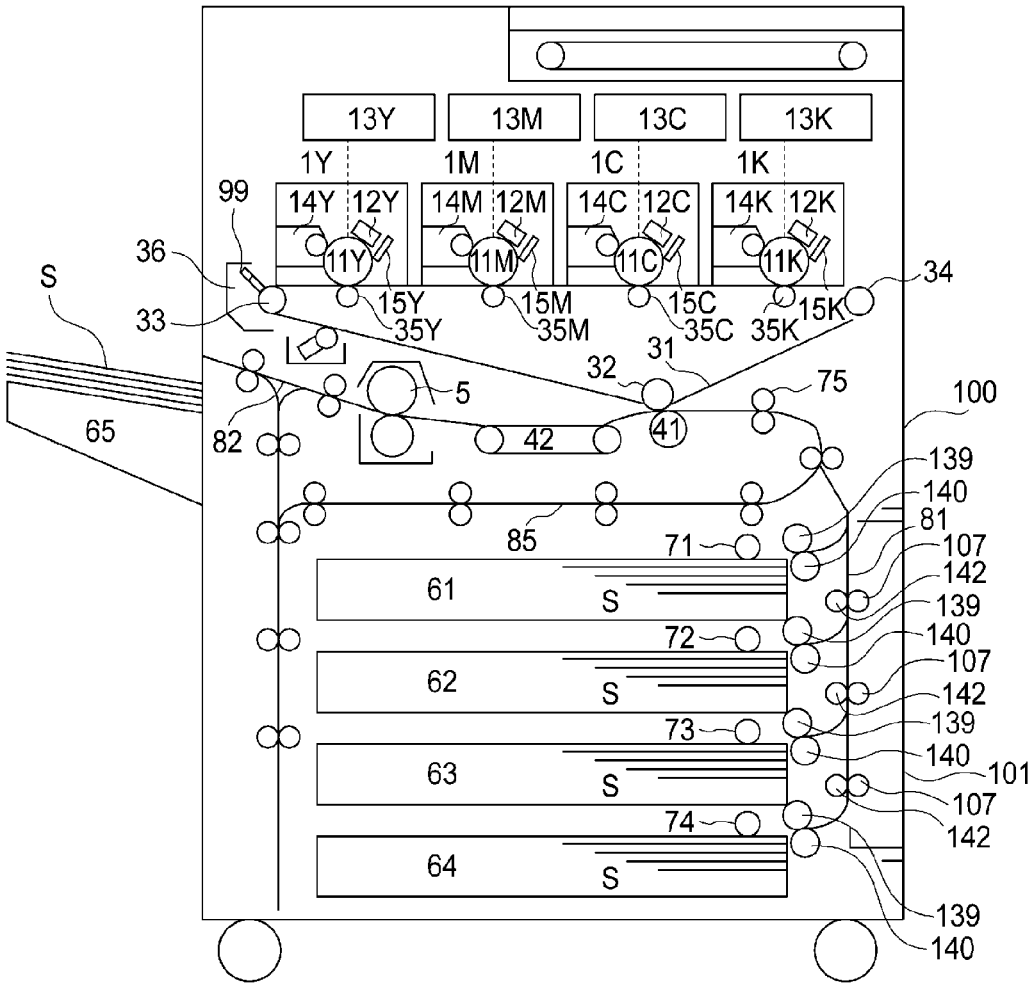
FIG. 1 is a sectional view illustrating the configuration of an image forming apparatus including a sheet conveying apparatus according to the invention.

FIG. 1 is a schematic diagram illustrating the configuration of the image forming apparatus including the sheet conveying apparatus according to the invention.

An image forming apparatus 100 illustrated in FIG. 1 is an image forming apparatus that adopts a tandem intermediate transfer type in which image forming portions 1Y, 1M, 1C, and 1K are arranged in series in a horizontal portion of an intermediate transfer belt 31. The image forming apparatus 100 forms a full-color image on a sheet S according to an electrophotographic system in response to image information (signal) transmitted from an external apparatus. In the following description, the image forming portions 1Y, 1M, 1C, and 1K are sometimes represented by the image forming portions 1 for description. The same also applies other image forming process members.

The image forming portions 1 forms respective color toner images of yellow Y, magenta M, cyan C, and black K on photosensitive drums 11Y, 11M, 11C, and 11K serving as image bearing members and performs primary transfer to the same image position on the intermediate transfer belt 31.

The intermediate transfer belt 31 is suspended by a driving roller 33, a tension roller 34, and a transfer counter roller 32 used to perform secondary transfer and are rotated. On the internal periphery side of the intermediate transfer belt 31, primary transfer rollers 35Y, 35M, 35C, and 35K performing the primary transfer are disposed at positions facing the photosensitive drums 11, respectively.

A charging roller 12Y that uniformly charges the surface of the photosensitive drum 11Y and an exposure device 13Y that exposures the surface of the photosensitive drum 11Y and forms an electrostatic latent image are provided around the photosensitive drum 11Y that forms a toner image of the yellow Y. A development device 14Y that forms a toner image by transitioning toner to the electrostatic latent image onto the surface of the photosensitive drum 11Y and a cleaning member 15Y that removes the toner remaining on the photosensitive drum 11Y after the primary transfer of the toner image are also provided.

Configurations in which toner images of the respective colors of the magenta M, the cyan C, and the black K are formed are the same as that in the case of forming the toner image of the yellow Y described above. Therefore, the suffix Y in the above description is substituted with M, C, and K and the overlapping description of each color will not be repeated.

On the other hand, a sheet S accommodated in a sheet cassette 61, 62, 63, or 64 is conveyed to a sheet conveying path 81 by rotating any of a feeding roller 71, 72, 73, or 74. A conveying roller 142 serving as a conveying rotating member installed on the body side (apparatus body side) of the image forming apparatus 100 is rotatably driven on the sheet conveying path 81 by a motor or the like serving as a driving source (not illustrated) installed in the body of the image forming apparatus 100.

A follower roller 107 serving as a follower rotating member that is pressed against the conveying roller 142 and is rotated in a follow manner is provided on the side (door side) of a door 101 that can be opened and closed with respect to the body (apparatus body) of the image forming apparatus 100. The sheet S sent to the sheet conveying path 81 is nipped by the conveying roller 142 and the follower roller 107 and is conveyed.

A registration roller 75 conveys the sheet S to a secondary transfer nip portion in which the secondary transfer roller 41 and the transfer counter roller 32 are abutted through the intermediate transfer belt 31 at an appropriate timing with the toner image on the intermediate transfer belt 31.

Next, the sheet S to which the toner image on the intermediate transfer belt 31 is transferred through an operation of the secondary transfer roller 41 in the secondary transfer nip portion is born on a conveying belt 42 and is conveyed to a fixing device 5. The toner image is fixed to the surface of the sheet S so that the full-color image can be fixed through heating and pressurizing by the fixing device 5. Thereafter, the sheet S is discharged to a discharge tray 65 through a discharge path 82. The toner remaining on the intermediate transfer belt 31 is removed by a cleaning member 99 and is received inside a waste-toner container 36.

Figure 3:
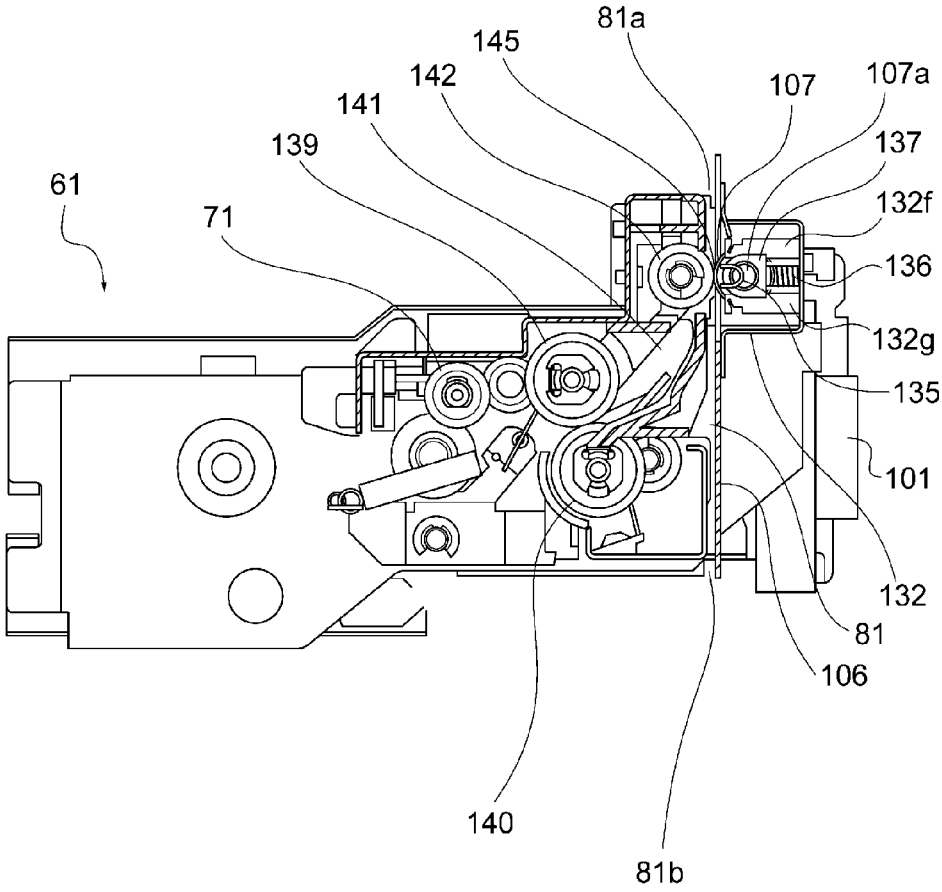
FIG. 3 is a sectional view illustrating the configuration of a conveying rotating member and a follower rotating member installed in a sheet feeding portion of the sheet conveying apparatus according to a first embodiment of the invention.

As illustrated in FIG. 3, pairs of rollers configured by the conveying rollers 142 and the follower rollers 107 nipping the sheet S and conveying the sheet S to the downstream side are installed on the sheet conveying path 81. Further, a conveying guide plate 106 is provided which ensures a regulated gap, while maintaining the posture of the sheet S and guides the conveying of the sheet S.

When the sheet S is jammed in the sheet conveying path 81, the user can remove the jammed sheet S by opening the door 101 since the door 101 is formed on one side of the sheet conveying path 81.

Figure 2:
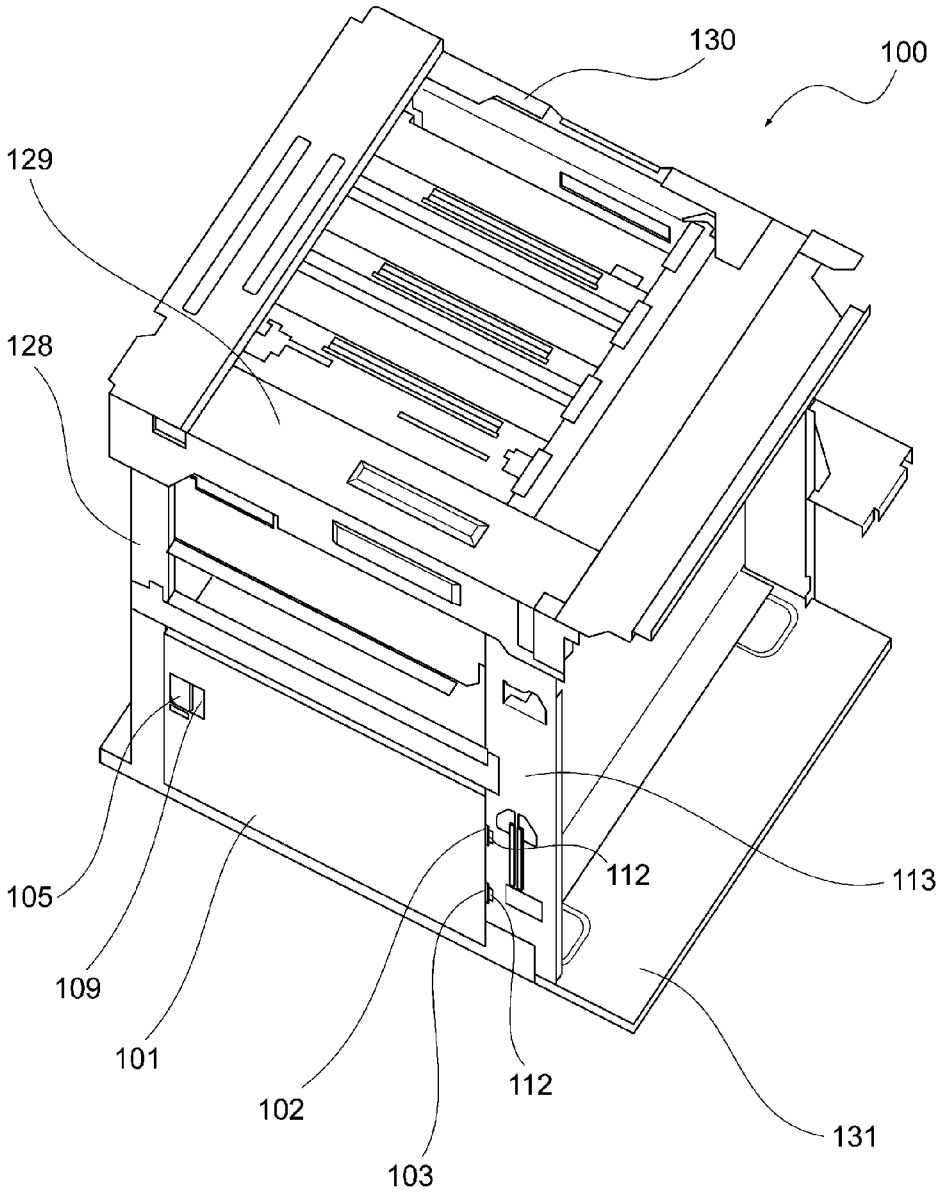
FIG. 2 is a perspective view illustrating a relation between a door and a frame of a body of the image forming apparatus.

At the time of a maintenance service, the user holds a concave portion 109 of the door 101 formed on the side of the sheet conveying path 81 with his or her hand, as illustrated in FIG. 2, to perform a checkup work, a cleaning work, an exchange work of a consumable component, an oil filling work, or the like in the inside of the body of the image forming apparatus 100. Then, the user can open a knob 105 to open the door 101.

FIG. 2 is a perspective view illustrating a disposition relation between the door 101 and a frame of the body of the image forming apparatus 100.

FIG. 2 is the diagram, when the image forming apparatus 100 illustrated in FIG. 1 is viewed from the right side of FIG. 1, and illustrates a state in which each unit, a mounted component, an electric component, an exterior cover, and the like inside the body of the image forming apparatus 100 are not illustrated for convenience and the door 101 configured to be opened and closed with respect to the body of the image forming apparatus 100 is mounted.

A frame casing of the image forming apparatus 100 is configured by a combination of constituent components such as a front right post 128, an upper right stay 129, an upper left stay 130, a rear side plate 113, and a bottom plate 131 illustrated in FIG. 2. In FIG. 2, the door 101 is mounted in a closed state. Since the knob 105 is formed in the door 101, the user can open the door 101 by holding his or her hand in the concave portion 109 and uplifting the knob 105.

FIG. 3 is a sectional view illustrating a disposition relation between the conveying roller 142 and the follower roller 107 provided in a topmost sheet cassette 61. Since the diagrams of the disposition relations between the conveying rollers 142 and the follower rollers 107 provided in the other sheet cassettes 62, 63, and 64 are substantially the same, the disposition relation between the conveying roller 142 and the follower roller 107 provided in the topmost sheet cassette 61 will be described as a representative and the repeated description will be not made.

In FIG. 3, the sheet S accommodated in the sheet cassette 61 is picked up by the feeding roller 71. Then, the topmost sheet S is separated and fed according to a retard system in which separation is realized by a feeding roller 139 rotating in a feeding direction and a separating roller 140 rotating in an opposite direction to the feeding direction.

Here, the sheet S separated one by one passes through a feeding guide 141, is nipped in a nip portion 145 in which the conveying roller 142 and the follower roller 107 are abutted, and is conveyed. The sheet S sent to the sheet conveying path 81 is further conveyed toward an upper sheet conveying path 81*a* which is the downstream side of a sheet conveying direction.

Likewise, the sheet S fed from the sheet cassette 62 on the lower side is conveyed from a lower sheet conveying path 81*b*. The conveying guide plate 106 facing the conveying roller 142 is disposed to be substantially vertical with respect to the body of the image forming apparatus 100. A reinforcing stay 132 is mounted on the opposite side to the conveying roller 142.

The stay 132 mounted on the conveying guide plate 106 is provided with bearing guides 132*f* and 132*g* that slidably guide a bearing 137 axially supporting a rotation shaft 107*a* of the follower roller 107 so that the rotation shaft 107*a* is rotatable.

Figure 8:
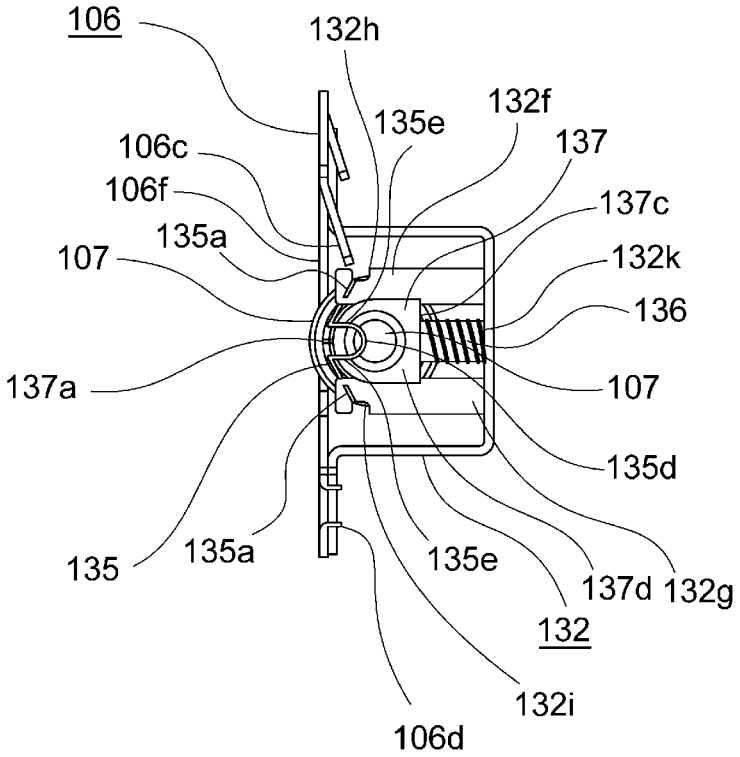
FIG. 8 is a longitudinal sectional view illustrating the configuration of the sheet conveying apparatus according to the first embodiment of the invention.

As illustrated in FIG. 8, a coil spring 136 serving as a pressing portion that presses the follower roller 107 against the conveying roller 142 is provided between a spring abutting surface 137*c* of the bearing 137 and a spring seating surface 132*k* of the stay 132. Notches 132*h* and 132*i* serving as locking portions are formed at the ends of the bearing guides 132*f* and 132*g* formed in the stay 132.

Hook portions 135*a* formed at both ends of a wire spring 135 illustrated in FIG. 9 lock with the notches 132*h* and 132*i*. Pressing portions 135*c* which are parts of the middle of the wire spring 135 are abutted and engage with an arc-shaped spring reception surface 137*a* of the bearing 137, and the restoring force of the wire spring 135 is applied against the pressing force of the coil spring 136 so maintain the bearing 137.

As illustrated in FIG. 9, a pair of L-shaped hook portions 135*a* that locks with the notches 132*h* and 132*i* formed at the ends of the bearing guides 132*f* and 132*g* formed in the stay 132 is formed at both ends of the line spring 135. Further, a pair of hook arm portions 135*b* perpendicularly connected to the hook portions 135*a* is formed. Furthermore, a pair of the pressing portions 135*c* is formed which is perpendicularly connected to the hook arm portions 135*b* and is abutted and engages with the spring reception surface 137*a* of the bearing 137.

A pair of flexible arm portions 135*e* is formed which is perpendicular to the pressing portions 135*c*, is disposed at a predetermined inclination angle with respect to the hook arm portions 135*b*, and can restrain the bearing 137 in an axial direction so as to face a side surface (end surface) 137*d* of the bearing 137. Further, a semicircular flexible portion 135*d* is formed which is connected to the pair of flexible arm portions 135*e* and formed in the middle of the line spring 135. The line spring 135 according to this embodiment is formed as the U-shaped flexible portion 135*d* by the pair of flexible arm portions 135*e* and the semicircular flexible portion 135*d*.

The bearing guides 132*f* and 132*g* formed in the stay 132 guide the bearing 137 such that the bearing 137 can move in a direction (right and left directions of FIG. 8) of the pressing force when the compressed coil spring 136 is extended. In correspondence with a change in the position of the bearing 137 moving along the bearing guides 132*f* and 132*g*, the pressing portions 135*c* which are the parts of the middle of the line spring 135 are normally abutted and engage with the spring reception surface 137*a* of the bearing 137 to follow by the restoring force of the line spring 135.

Figure 4:
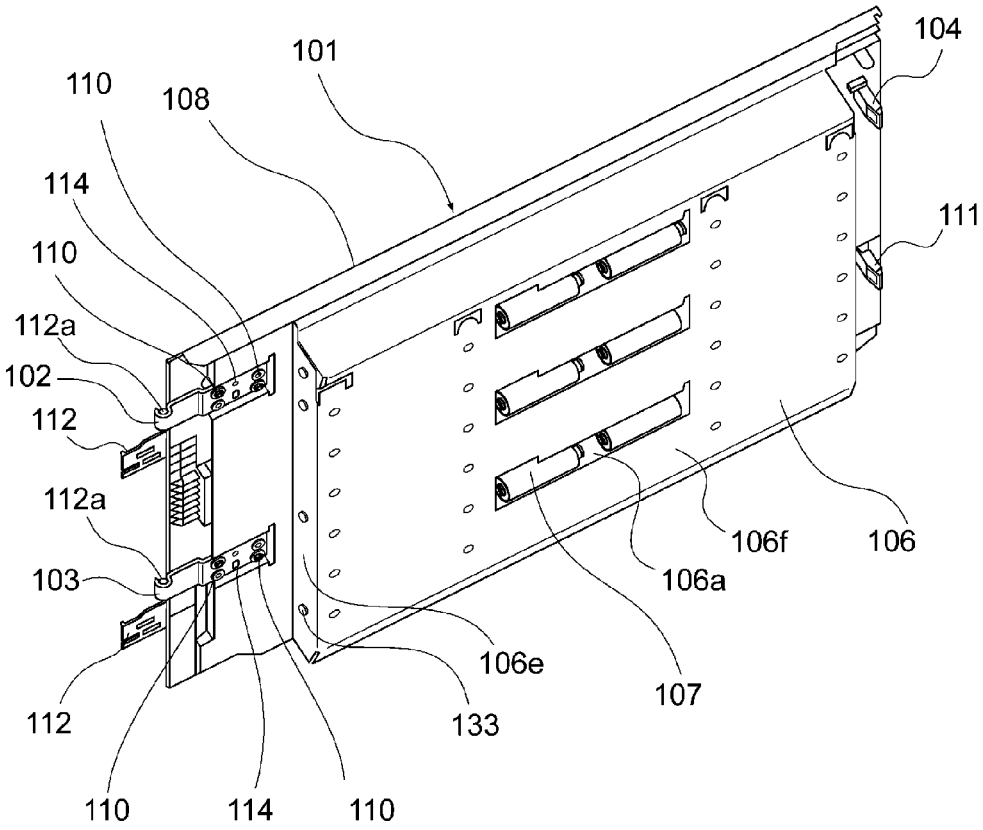
FIG. 4 is a perspective view illustrating a configuration of a door side in the sheet conveying apparatus according to the first embodiment of the invention.

FIG. 4 is a perspective view illustrating the configuration of the door 101 configured to be opened and closed through hinges 102 and 103 in the body of the image forming apparatus 100. As illustrated in FIG. 4, a pair of upper and lower hinges 102 and 103 is formed on one side of the door 101. Hook portions 104 and 111 holding the door 101 when the door 101 is closed are formed on the opposite side to the side of the hinges 102 and 103 of the door 101. The knob 105 interlocking with the hook portions 104 and 111 are formed on the surface of the exterior cover 108, as illustrated in FIG. 2.

The conveying guide plate 106 formed of an electrogalvanized steel plate or the like and guiding the conveying of the sheet S is formed on the inner surface of the door 101. A detachable hole 106*a* is formed within a sheet conveying width (within a range of a width in a direction perpendicular to the conveying direction of the sheet S) of the conveying guide plate 106 in which the sheet S is conveyed.

The line spring 135, the bearing 137, the follower roller 107, and the coil spring 136 are configured to be integrally mounted and detached from the detachable hole 106*a*. When the line spring 135, the bearing 137, the follower roller 107, and the coil spring 136 are integrally mounted and detached from the detachable hole 106*a*, the door 101 is opened from the body (apparatus body) of the image forming apparatus 100.

The hook portions 135*a* of the line spring 135 are mounted and detached from the notches 132*h* and 132*i* formed at the ends of the bearing guides 132*f* and 132*g* formed in the stay 132. Thus, the line spring 135, the bearing 137, the follower roller 107, and the coil spring 136 are configured to be integrally mounted and detached.

Figure 7A:
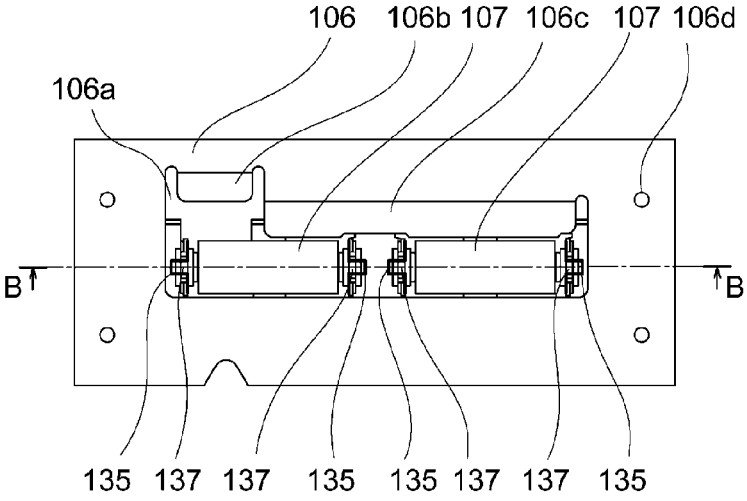
FIG. 7A is a front view illustrating the configuration of a detachable hole formed in the conveying guide plate.
Figure 7B:
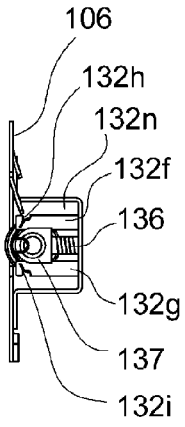
FIG. 7B is a longitudinal sectional view illustrating the configuration of the detachable hole formed in the conveying guide plate.
Figure 7C:
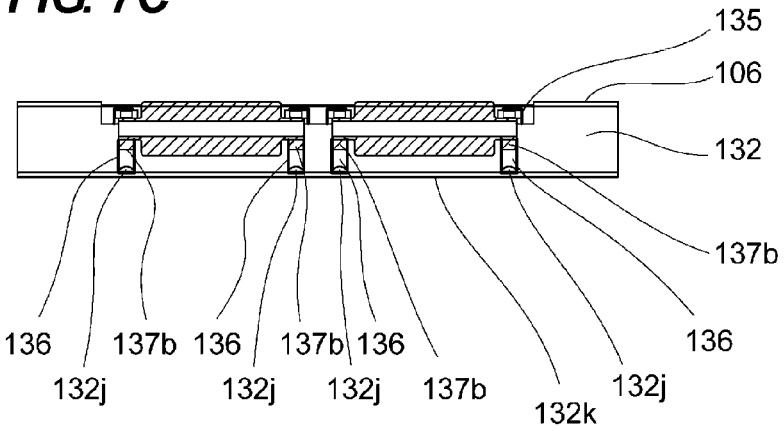
FIG. 7C is a sectional view taken along line B-B of FIG. 7A.

As illustrated in FIG. 7C, one end of the coil spring 136 is fitted into and engages with a boss 137*b* that has a circular cross-sectional surface and protrudes from the spring abutting surface 137*c* of the bearing 137. Further, the other end of the coil spring 136 is detachably fitted into an emboss 132*j* that has a protruding shape and protrudes from the spring seating surface 132*k* of the stay 132.

Three detachable holes 106*a* according to this embodiment are vertically arranged in parallel. A pair of two follower rollers 107 formed of a material such as a POM (Polyoxymethylene) resin having a good slippery property is disposed to the right and left inside each detachable hole 106*a*. A total of six follower rollers 107 are arranged inside the detachable holes 106*a* arranged vertically in three lines in the door 101.

The exterior cover 108 formed of a resin and serving as an outer surface is formed outside of the door 101.

Retractable hinges capable of mounting and detaching the door 101 on and from the body of the image forming apparatus 100 are used as the hinges 102 and 103 formed vertically on the back side of the door 101. The retractable hinges are fitted to be mounted on hinge shaft portions 112*a* of the rotation center of the hinges 102 and 103 rotating at the time of opening and closing the door 101 in upper and lower thrust directions so as to be inserted and detached.

The hinge 112 fixed to the body side of the image forming apparatus 100 is fixed to the end of the rear side plate 113, which is the frame casing of the body of the image forming apparatus 100 illustrated in FIG. 2, by a fastening member such as a screw.

As illustrated in FIG. 4, a hinge plate 114 of a movable side fixed to the door 101 is fixed to the back side of the door 101 by a fastening member such as a screw 110.

Figure 5A:
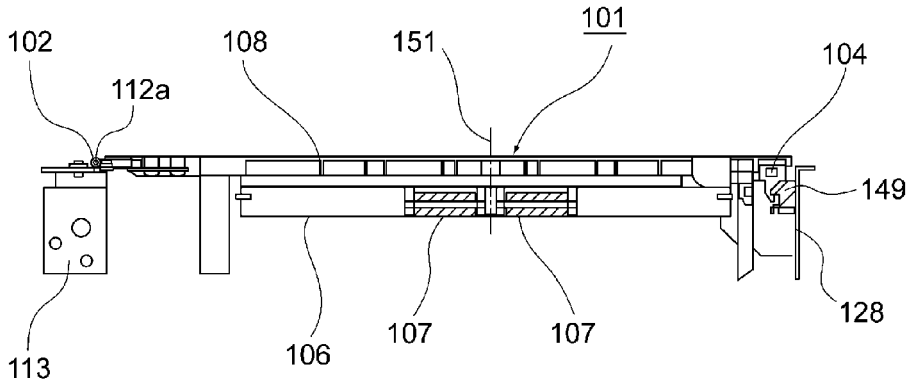
FIG. 5A is an illustrating the configuration of the door side in the sheet conveying apparatus according to the first embodiment of the invention and is a sectional view taken along line A-A of FIG. 5B.
Figure 5B:
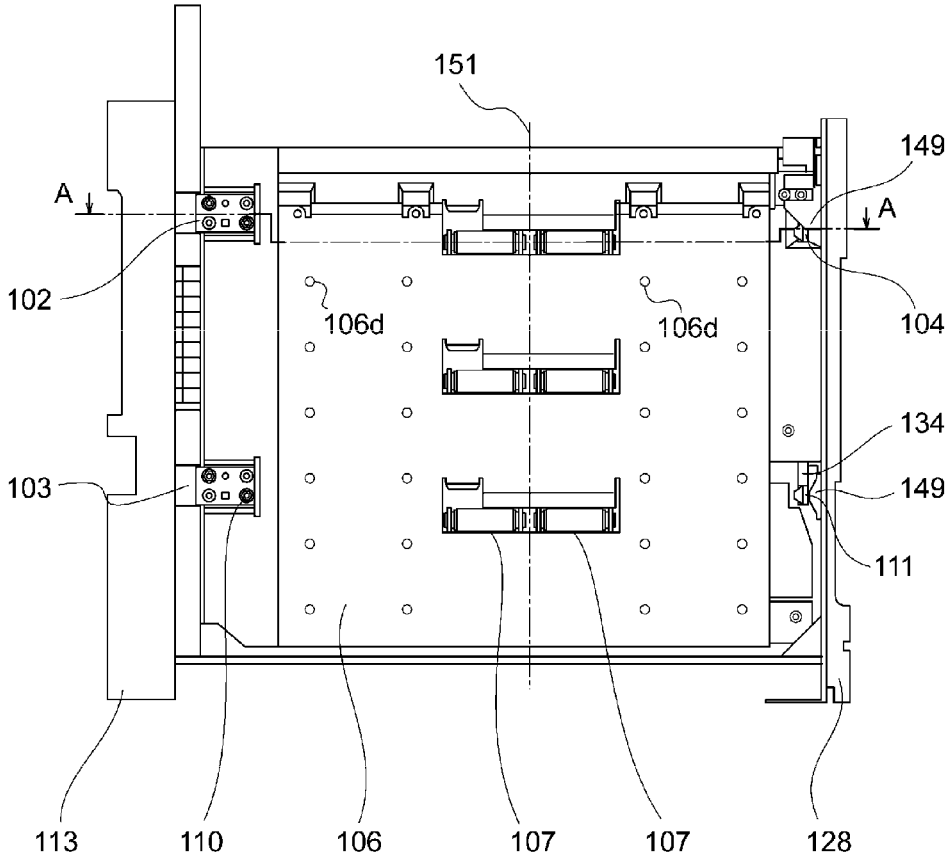
FIG. 5B is a plan view illustrating the configuration of the door side in the sheet conveying apparatus according to the first embodiment of the invention.
Figure 6:
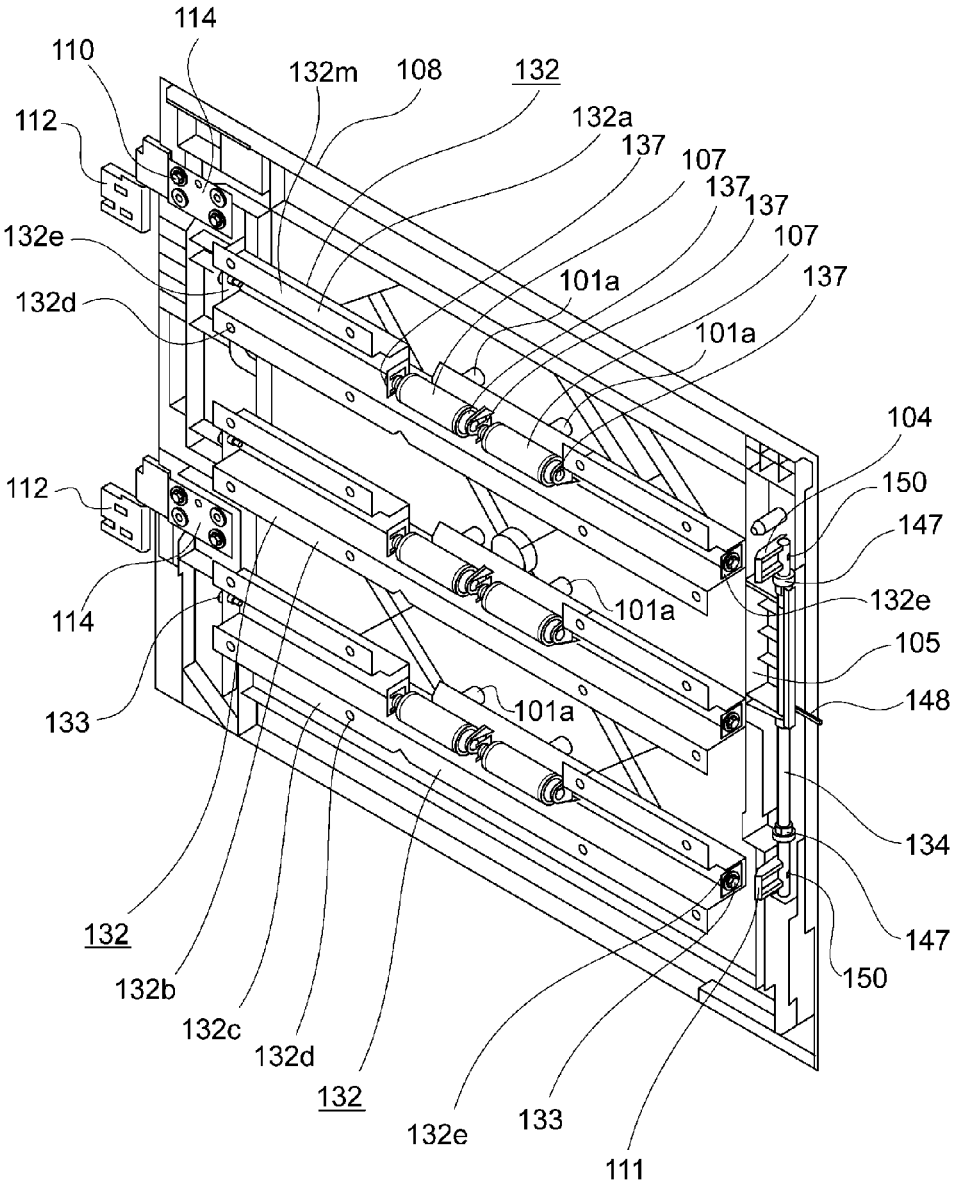
FIG. 6 is a perspective view illustrating the configuration of the door side in the sheet conveying apparatus, when a conveying guide plate is transparently viewed, according to the first embodiment of the invention.

FIG. 5B is a front view illustrating the inside of the door 101 and FIG. 5A is a cross-sectional view taken along line A-A of FIG. 5B. FIG. 6 is a perspective view illustrating the internal configuration of the door 101, when the conveying guide plate 106 is transparently viewed.

The hinges 102 and 103 attached to the rear side plate 113 illustrated in FIG. 2 are fastened and connected to the conveying guide plate 106 and the exterior cover 108. The hook portions 104 and 111 formed on the front side of the door 101 illustrated in FIGS. 4, 5A, and 5B detachably engage to be maintained in holding projections 149 formed in the front right post 128, which is the frame casing of the body of the image forming apparatus 100.

As illustrated in FIG. 6, a shaft 134 is provided to be rotatable by the bearings 147 provided in the door 101. The hook portions 104 and 111 and the knob 105 are fixed to the shaft 134. The hook portions 104 and 111 are fastened to the shaft 134 by screws 150. Thus, when the knob 105 is held and rotated about the shaft 134, the hook portions 104 and 111 are rotated through the shaft 134 and are thus mounted and detached from the holding projections 149.

The shaft 134 is maintained to be rotatable through the bearings 147 provided in the door 101, and thus a force is normally applied to the hook portions 104 and 111 in a direction in which locks are hung on the holding projections 149 by torsion coil springs 148. When the knob 105 is rotated against the applying force of the torsion coil springs 148, the hook portions 104 and 111 are taken off from the holding projections 149, so that the door 101 can be opened.

The reinforcing stays 132 are arranged in three lines to the right and left in parallel on the rear surface side of the conveying guide plate 106 of the door 101. The stays 132 are screwed to be fixed to screw holds formed in fixed pedestals 101*a* formed on the internal surface of the door 101 illustrated in FIG. 6.

The follower rollers 107 are accommodated and arranged in the concave portions 132*n* of the stay 132 having a hat-like cross section to be bilaterally symmetric centering on a center line 151 of the sheet conveying width illustrated in FIG. 5B. As illustrated in FIG. 6, an upper reinforcing stay 132*a*, an intermediate reinforcing stay 132*b*, and a lower reinforcing stay 132*c* are arranged in the substantially horizontal direction of the door 101.

The stays 132*a* to 132*c* all have the same shape and the rotation shafts 107*a* of the follower rollers 107 are axially supported by the bearings 137.

Screw seating surfaces 132*e* formed from curved portions curved and erected through sheet-metal processing are formed at the ends of the stay 132 in its length direction, as illustrated in FIG. 6. Screws 133 are inserted into through holes formed in side pieces 106*e* having a cross-sectional surface with an angled-C shape in the conveying guide plate 106, as illustrated in FIG. 4, and the screws 133 are threadably fastened into the screw holds formed in the screw seating surfaces 132*e*, so that the conveying guide plate 106 is fixed to the stays 132.

The bearing 137 is molded using a POM (Polyoxymethylene) resin, a PA (Polyamide) resin, a fluorine-based resin, or the like having good lubricity for the bearing guides 132*f* and 132*g* and abrasion resistance. To achieve high durability and a maintenance-free property, a sintered metallic molded component such as an iron-based sintered component, an iron-copper-based sintered component, or a copper-based sintered component having a good slidable property may be used. Further, a ball bearing or the like that slides to the bearing guides 132*f* and 132*g* may be provided.

FIGS. 7A to 7C are front and cross-sectional views illustrating the configuration of the follower roller 107 and the detachable hole 106*a*.

As illustrated in FIG. 6, the follower rollers 107, the bearings 137, and the coil springs 136 engage to be maintained by the line springs 135 in the middle of the stay 132 in the length direction. The bearings 137 axially support the rotation shafts 107*a* of the follower rollers 107. The coil springs 136 are fitted into the bosses 137*b* integrally molded to engage with the spring abutting surfaces 137*c* of the bearings 137.

The bearing 137 is slidably fitted to be maintained between the bearing guides 132*f* and 132*g* formed by curving parts of the stay 132 from the spring seating surface 132*k* by 90 degrees by sheet-metal processing.

As illustrated in FIG. 7C, the protrusion-shaped emboss 132*j* guiding the coil spring 136 is formed in the spring seating surface 132*k* receiving one end of the coil spring 136 provided in the stay 132.

As illustrated in FIG. 8, the notches 132*h* and 132*i* are formed at the ends of the bearing guides 132*f* and 132*g*.

Figure 9A:
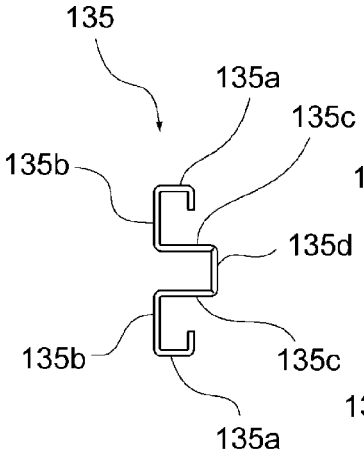
FIG. 9A is a plan view illustrating the configuration of a wire spring according to the first embodiment.
Figure 9B:
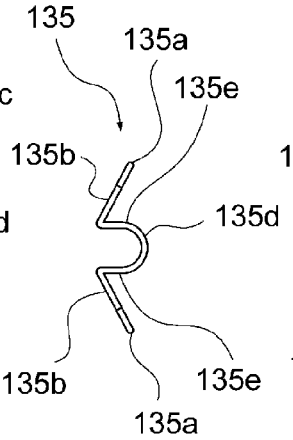
FIG. 9B is a side view illustrating the configuration of the wire spring according to the first embodiment.
Figure 9C:
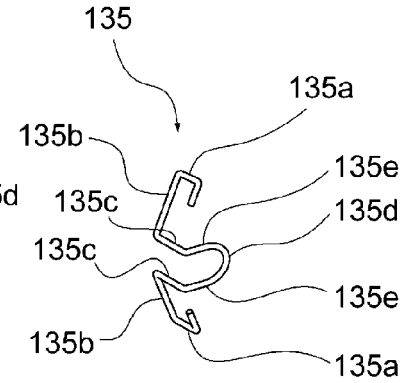
FIG. 9C is a perspective view illustrating the configuration of the wire spring according to the first embodiment.
Figure 10A:
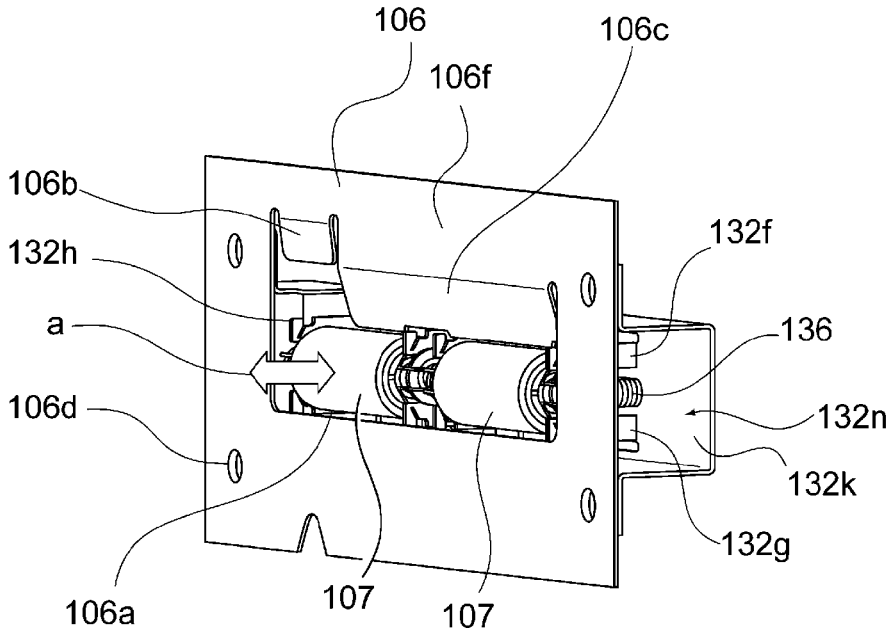
FIG. 10A is a perspective view illustrating the configuration of the sheet conveying apparatus according to the first embodiment of the invention.
Figure 10B:
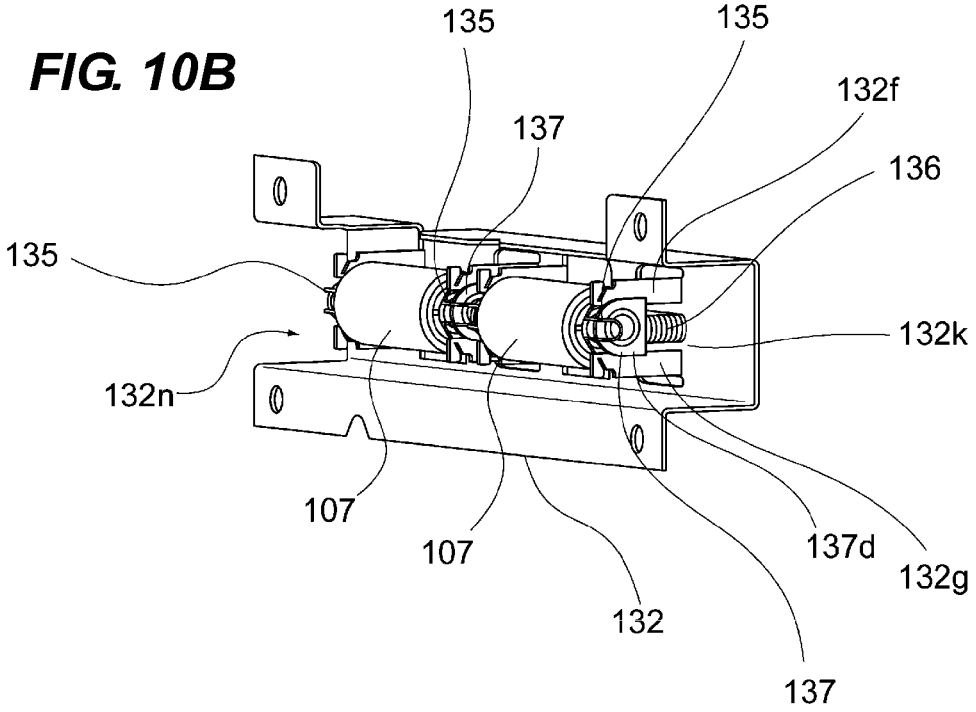
FIG. 10B is a perspective view illustrating the configuration of the sheet conveying apparatus according to the first embodiment of the invention.

FIGS. 8, 10A, and 10B are partially cross-sectional and perspective views illustrating the configuration of the follower roller 107 and the detachable hole 106*a*, as in FIGS. 7A to 7C. FIGS. 9A to 9C are plan, side, and perspective views illustrating the configuration of the line spring 135.

The conveying guide plate 106 and the stay 132 are fastened to a burring caulking portion 106*d* to be integrally fixed. As illustrated in FIG. 8, the stay 132 is curved to have a hat-like cross-sectional surface and is integrated with the conveying guide plate 106 to form a cross-sectional surface with a box-like shape. Thus, rigidity is improved in terms of strength, and thus deformation or flexibility does not occur even when the pressurizing force of the coil spring 136 is applied to the follower roller 107 or a force is applied from the surroundings due to an impact or the like when the door 101 is opened or closed.

In the middle of the stay 132 in the length direction, a pair of follower rollers 107 is disposed to be bilaterally symmetric centering on a center line 151 of the sheet conveying width of the sheet S passing through the sheet conveying path 81, as illustrated in FIG. 5B.

To integrate the conveying guide plate 106 and the stay 132, caulking holes 132*d* are formed in a fixed piece 132*m* of the stay 132 illustrated in FIG. 6. The plurality of caulking holes 132*d* is formed in any positions of each stay 132, as illustrated in FIGS. 5B and 6. The caulking holes 132*d* are matched to be integrally fastened to the burring caulking portions 106*d* illustrated in FIG. 7A.

The follower roller 107 is configured as a stepped roller that has a middle with a large diameter in the length direction and both right and left ends with a small diameter in the length direction. Both ends of the rotation shaft 107*a* of the follower roller 107 are axially supported to be rotatably by the bearing 137. As illustrated in FIGS. 11A to 11D, a large-diameter portion of the middle of the follower roller 107 in the length direction forms a nip portion 145 (see FIG. 3) together with the facing conveying roller 142, and thus the sheet S is nipped and conveyed by the nip portion 145.

As illustrated in FIGS. 7A to 7C, in the stay 132, the bearing guides 132*f* and 132*g* are formed symmetrically centering on the spring seating surface 132*k*. The bearing guides 132*f* and 132*g* can be formed from the surface of the spring seating surface 132*k* of the stay 132 by press working.

As illustrated in FIG. 7C, the protrusion-shaped emboss 132*j* with a diameter slightly smaller than the inner diameter of the coil spring 136 is formed in the middle of the spring seating surface 132*k* in the lateral direction. When one end of the coil spring 136 is fitted into the emboss 132*j* to be mounted, the emboss 132*j* guides the coil spring 136 to the middle of the spring seating surface 132*k* in the lateral direction to be positioned. Thus, even when the pressurizing force of the coil spring 136 is changed due to the conveying operation of the sheet S, the position at which the coil spring 136 is mounted can be determined without deviation.

The bearing 137 is configured to be slidable along the bearing guides 132*f* and 132*g*, and thus is configured to be slidably moved smoothly.

As illustrated in FIG. 7C, the boss 137*b* formed from a protrusion with a circular cross-sectional surface is formed in the middle of the spring abutting surface 137*c* of the bearing 137.

One end of the coil spring 136 is press-fitted into the boss 137*b* formed in the spring abutting surface 137*c* of the bearing 137 to be maintained by a tightening force applied in the inner diameter direction of the coil spring 136. Thus, the coil spring 136 is supported so that the axial direction of the coil spring 136 is substantially perpendicular to the spring seating surface 132*k* of the stay 132.

FIGS. 9A to 9C are plan, side, and perspective views illustrating the shape of the line spring 135 according to this embodiment.

The line spring 135 according to this embodiment includes the hook portions 135*a* to lock the line spring 135 into the notches 132*h* and 132*i* formed in the bearing guides 132*f* and 132*g* of the stay 132. The line spring 135 further includes the hook arm portions 135*b* supporting the hook portions 135*a*. The line spring 135 further includes the pressing portions 135*c* abutted to the spring reception surface 137*a* of the bearing 137. The wire spring 135 further includes the flexible portion 135*d* generating the restoring force to balance the load caused due to the pressurizing force of the coil spring 136. The wire spring 135 further includes the flexible arm portions 135*e* connecting the flexible portion 135*d* to the pressing portions 135*c* and flexibly opened and closed.

A spring line material such as the stainless SUS 304, WPB, SWPB, or SWIC can be used as the material of the wire spring 135.

As the wire spring 135 according to this embodiment, a wire spring which has an outer diameter of 0.5 mm as a line diameter, a 1.7 mm length of the flexible arm portion 135*e*, and a 2 mm radius of the flexible portion 135*d* is formed of a cheap SWIC material for which plating is not necessary in a subsequent process.

Next, referring to FIGS. 10A to 10B, an order will be described in which the wire springs 135, the bearings 137, the follower rollers 107, and the coil springs 136 are integrally mounted and detached from the detachable hole 106*a* formed in the conveying guide plate 106.

First, an order will be described in which the wire springs 135, the bearings 137, the follower rollers 107, and the coil springs 136 are integrally mounted on the detachable hole 106*a* formed in the conveying guide plate 106.

First, by using two bearings 137 as one set, one end of the coil spring 136 is mounted to be maintained on the boss 137*b* formed in the spring abutting surface 137*c* of each bearing 137 in advance.

Next, the bearing 137 is mounted on both ends of the rotation shaft 107*a* of the follower roller 107. Then, the follower roller 107, the bearing 137, and the coil spring 136 are integrally set. In this state, the bearing 137 is accommodated inside the concave portion 132*n* of the stay 132, while being inserted between the right and left bearing guides 132*f* and 132*g* provided on the stay 132 from the detachable hole 106*a* formed in the conveying guide plate 106.

When the follower roller 107 is accommodated inside the concave portion 132*n* of the stay 132, the flexible portion 135*d* of the wire spring 135 faces and comes into contact with the side end of the rotation shaft 107*a* of the follower roller 107 in the length direction. Thus, when the follower roller 107 is mounted and detached, position deviation in the direction of the rotation shaft 107*a* can be prevented between the follower roller 107 and the bearing 137. Therefore, when the bearing 137 is inserted between the bearing guides 132*f* and 132*g*, position adjustment can be realized easily, and thus workability is improved.

The bearing 137 is inserted between the bearing guides 132*f* and 132*g*. Then, the other end of the coil spring 136 of which one end is fitted to be maintained into the boss 137*b* formed in the spring abutting surface 137*c* of the bearing 137 engages to be fitted into the emboss 132*j* protruding from the spring seating surface 132*k* of the stay 132. Then, the coil spring 136 is guided to the emboss 132*j* and reaches the spring seating surface 132*k*.

Next, the hook portions 135*a* of the wire spring 135 are hooked to engage with the notches 132*h* and 132*i* formed in the front ends of the bearing guides 132*f* and 132*g*, while the pressing portions 135*c* of the wire spring 135 is abutted to the spring reception surface 137*a* of the bearing 137.

Thus, as illustrated in FIG. 8, due to the restoring force of the wire spring 135 in which there is friction forming the flexible portion 135*d* partially looped in a U shape, the bearing 137 is stopped at a position at which the pressurizing force generated by the coil spring 136 and the reactive force of the restoring force of the wire spring 135 are balanced. Then, the bearing 137 can be maintained to be movable along the bearing guides 132*f* and 132*g*.

When the pressurizing force of the coil spring 136 is applied to the wire spring 135 through the bearing 137, the wire spring 135 is curved. Then, in the notches 132*h* and 132*i* formed in the front ends of the bearing guides 132*f* and 132*g*, a component force of the inside direction vector in which a pair of hook portions 135*a* of the wire spring 135 is attracted in the inside direction works. Thus, the wire spring 135 is not deviated due to the pressurizing force of the coil spring 136.

Figure 11A:
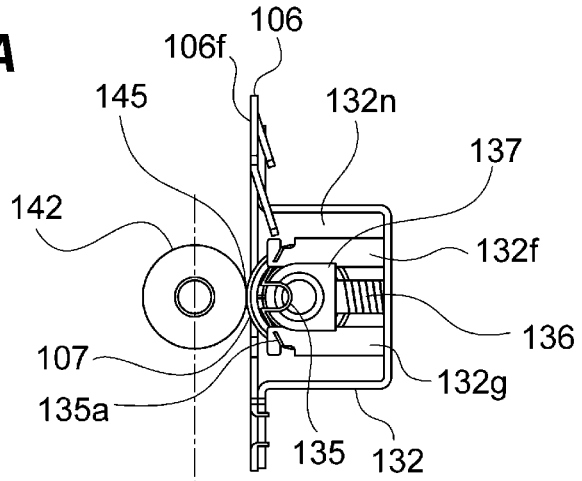
FIG. 11A is a sectional view illustrating a state in which a positional relation between a conveying rotating member and a follower rotating member is changed.

In this embodiment, in the coil spring 136, there is no sheet S and the pressurizing force of 2.7 N (about 275 gf) is set at the abutting position of the follower roller 107 to the conveying roller 142, as illustrated in FIG. 11A.

Next, an order will be described in which the wire springs 135, the bearings 137, the follower rollers 107, and the coil springs 136 are integrally detached from the detachable hole 106*a* formed in the conveying guide plate 106.

First, the user inserts his or her hand into the detachable hole 106*a* formed in the conveying guide plate 106 and takes off the hook portions 135*a* of the wire spring 135 from the notches 132*h* and 132*i* formed at the front ends of the bearing guides 132*f* and 132*g*. Thus, the bearings 137 are extruded by the pressurizing force of the coil springs 136 and the follower rollers 107 can be easily detached in the direction of an arrow a in FIG. 10A by picking with a fingertip.

As described above, the detachable hole 106*a* is formed in the conveying guide plate 106 provided on the inside surface side of the door 101 to integrally detach the wire springs 135, the bearings 137, the follower rollers 107, and the coil springs 136. Thus, the follower rollers 107, the bearings 137, the coil springs 136 mounted on the bearings 137, and the wire springs 135 can be mounted and detached from the inside surface side of the conveying guide plate 106.

As illustrated in FIG. 10A, guide inclination surfaces 106*b* and 106*c* are formed on the downstream side (upper side of FIG. 10A) of the detachable hole 106*a* in the sheet conveying direction. Even when the front end of the sheet S is entered into the detachable hole 106*a*, the front end of the sheet S is guided from the detachable hole 106*a* to the conveying guide surface 106*f* becoming the sheet conveying path 81 by the guide inclination surfaces 106*b* and 106*c*.

In general, when about one million sheets S of the A4 size were conveyed, the durability life of an image forming apparatus was finished about ten years ago from the current. This case is an example when an MFP (Multifunction Printer or Multifunction Peripheral) or the like of a medium-speed machine class is used. Currently, when about three million sheets S of the A4 size are conveyed, the durability life of an image forming apparatus is finished.

To use the image forming apparatus 100 longer, improvement and optimization of individual components are designed and a maintenance-free apparatus is in progress.

On the other hand, an improvement in the maintenance property by a serviceman is also preferable. It is desirable to reduce an initial cost which is a price of an image forming apparatus including production equipment and die investment reflected to the sale price of a product and a running cost relevant to maintenance, service, and supply after installation for a user. Maintenance such as easy exchange at the time of cleaning or checking up an apparatus is required to be improved.

In this embodiment, the hook portions 135*a* of the wire spring 135 are detached from the notches 132*h* and 132*i* formed in the front ends of the bearing guides 132*f* and 132*g* provided in the stay 132. Thus, it is possible to easily exchange or clean and check up the components of the follower roller 107, the bearing 137, and the coil spring 136. Therefore, since the maintenance time can be shortened, the contribution to the maintenance efficiency can be achieved.

FIGS. 11A to 11D are sectional views illustrating states in which a positional relation between the conveying roller 142 at a fixed position and the follower roller 107 is changed.

In correspondence with the change in the position of the follower roller 107 provided on the side of the door 101, the position of the bearing 137 is slid and moved between the bearing guides 132*f* and 132*g*. At this time, the pressing portions 135*c* of the wire spring 135 normally come into contact with the spring reception surface 137*a* of the bearing 137 by the restoring force (elastic force) of the wire spring 135 and follow the movement of the bearing 137. Thus, the sheet conveying path 81 is disposed normally at the most retracted position without interference of the wire spring 135 and the bearing 137 to the conveyed sheet S.

FIG. 11A illustrates the state in which there is no sheet S in the nip portion 145 between the conveying roller 142 and the follower roller 107, and the conveying roller 142 and the follower roller 107 are directly abutted. A portion between both ends of the wire spring 135 of which both ends are mounted on the stay 132 is abutted to a portion of the bearing 137 on the side of the conveying roller 142 (the side of the conveying rotating member).

Figure 11B:
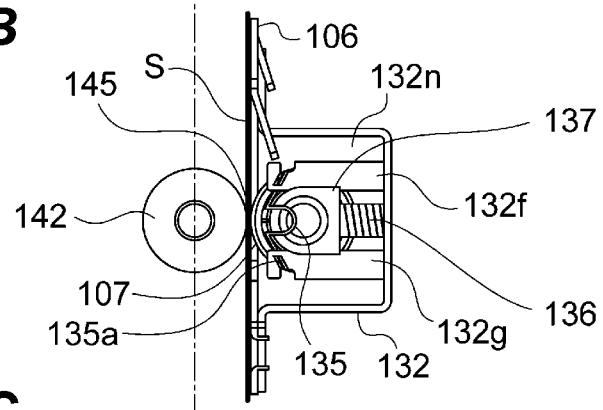
FIG. 11B is a sectional view illustrating the state in which the positional relation between the conveying rotating member and the follower rotating member is changed.

FIG. 11B illustrates the state in which the thick sheet S passes through the nip portion 145 between the conveying roller 142 and the follower roller 107. When the position of the bearing 137 is changes so that two pressing portions 135*c* of the wire spring 135 normally come into contact with the arc-shaped spring reception surface 137*a* irrespective of the position of the bearing 137, the flexible portion 135*d* formed between the two pressing portions 135*c* is deformed.

A thick sheet used in the image forming apparatus 100 is regulated by a basis weight which is a weight per unit area and 45 g/m$^2$ to 230 g/m$^2$ is generally considered to be thick. The basis weight of the sheet S used in the image forming apparatus 100 according to this embodiment is 200 g/m$^2$ and thickness of the sheet S is about 0.41 mm. Accordingly, the follower roller 107 nipping the sheet S against the conveying roller 142 at the fixed position is moved to the right direction of FIGS. 11A to 11D by the thickness of the sheet S.

Likewise, the bearing 137 axially supporting the rotation shaft 107*a* of the follower roller 107 is also moved to the right direction of FIGS. 11A to 11D by the thickness of the sheet S. The pressing portions 135*c* of the wire spring 135 normally abutted to the spring reception surface 137*a* of the bearing 137 by the restoring force of the wire spring 135 are also moved integrally with the bearing 137 to the right direction of FIGS. 11A to 11D by the thickness of the sheet S.

A spring constant of the coil spring 136 according to this embodiment is 0.44 N/mm (about 45 gf/mm). Thus, when the follower roller 107 is moved to the right direction of FIGS. 11A to 11D by the 0.41 mm thickness of the sheet S, the pressurizing force of the coil spring 136 compressed that much increases by 0.18 N (about 18.45 gf). Since the restoring force of the wire spring 135 and the pressurizing force of the coil spring 136 are applied mutually, the sheet S is conveyed along the conveying guide surface 106*f* of the conveying guide plate 106 along the sheet conveying path 81.

As illustrated in FIG. 11B, the sheet S passes through the nip portion 145 between the conveying roller 142 and the follower roller 107. At this state, the wire spring 135 is set so as to maintain the state in which the pressing portions 135*c* come into contact with the spring reception surface 137*a* of the bearing 137 by the restoring force of the wire spring 135.

Figure 11C:
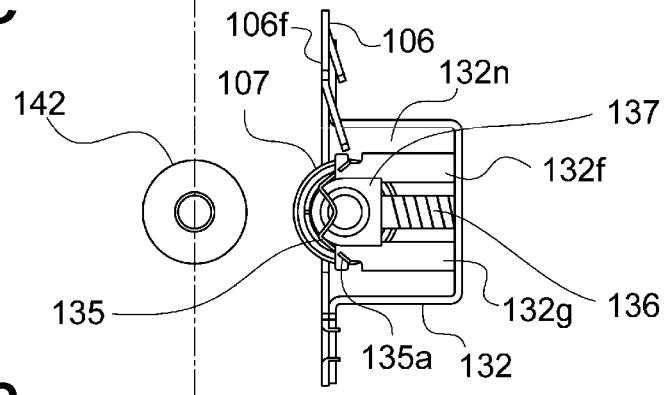
FIG. 11C is a sectional view illustrating the state in which the positional relation between the conveying rotating member and the follower rotating member is changed.

FIG. 11C illustrates the state in which the door 101 is opened with respect to the body of the image forming apparatus 100 and the follower roller 107 is separated from the conveying roller 142. At this time, the pressing of the follower roller 107 against the conveying roller 142 is cancelled and the follower roller 107 is pushed to the side of the conveying roller 142 by the pressurizing force of the coil spring 136.

FIG. 11A illustrates the position of the follower roller 107 when the conveying roller 142 and the follower roller 107 are directly abutted to each other. FIG. 11C illustrates the position of the follower roller 107 when the follower roller 107 is separated from the conveying roller 142. The position of the follower roller 107 illustrated in FIG. 11A is moved to the side of the conveying roller 142 (the left side of FIG. 11C) by 3.3 mm from the position of the follower roller 107 illustrated in FIG. 11C.

When the follower roller 107 is separated from the conveying roller 142, as illustrated in FIG. 11C, the load of the coil spring 136 is the pressurizing force of 4.15 N (about 423.4 gf), and thus the pressurizing force and the restoring force of the wire spring 135 are balanced.

When the follower roller 107 is separated from the conveying roller 142, as illustrated in FIG. 11C, a dimensional tolerance is set to about 1 mm.

Figure 11D:
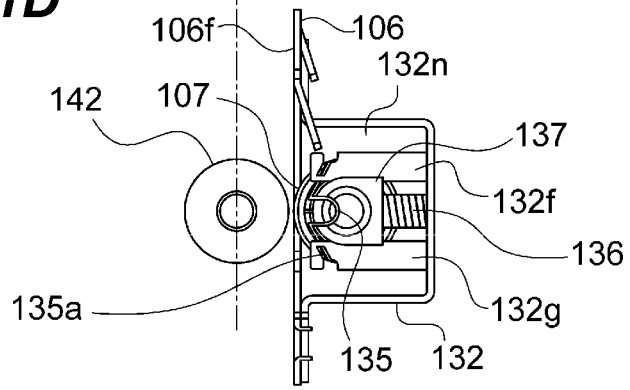
FIG. 11D is a sectional view illustrating the state in which the positional relation between the conveying rotating member and the follower rotating member is changed.

FIG. 11D illustrates the state in which the dimensional tolerance of the door 101 is the maximum. In this embodiment, since six follower rollers 107 are used and two coil springs 136 are used for one follower roller 107, a total of 12 coil springs 136 are used.

Thus, a sum of the pressurizing forces of the twelve coil springs 136 is 32.36 N (about 3.3 kgf). Further, a spring tolerance of the coil spring 136 is about ±10%. Therefore, when the spring tolerance of the coil spring 136 is the maximum, the maximum pressurizing force of the sum of the pressurizing forces of the twelve coil springs 136 is 35.60 N (about 3.63 kgf).

When a conveying guide formed of a resin according to the related art is used, the maximum pressurizing force of the sum of the pressurizing forces of the twelve coil springs 136 may not be sufficient for the reinforcement of the conveying guide. Therefore, the flexibility of about 2 mm occurs. Further, even when a reinforcing rib is added to the conveying guide, a load is applied for a long time. Therefore, an elastic repulsive force gradually decreases due to aging deterioration and permanent deformation occurs before long. Accordingly, the flexibility gradually increases. Accordingly, in a case of a high durable MFP (Multifunction Printer or Multifunctional Peripheral), the sheet conveying force gradually decreases. Thus, there is a problem that the sheet S may be skew-fed.

In this embodiment, by providing the conveying guide plate 106 formed of a metal plate with the reinforcing stay 132, the deformation caused due to the maximum pressurizing force of the sum of the pressurizing forces of the twelve coil springs 136 can be reduced to about 0.05 mm. Therefore, durability may be achieved even when the coil springs are changed over time.

Further, the stability of the pressurizing force to the follower roller 107 can be contributed, the stability increases for conveying the sheet S that much. Therefore, the performance rarely deteriorates even for long-time change and a product specification can be satisfied.

In the sheet conveying path 81, when the sheet S is a thick sheet, the follower roller 107 is pushed in the right direction of FIG. 11B due to the strong body of the thick sheet S. The pressurizing force of the coil spring 136 becomes weak, and thus the outer circumferential surface of the follower roller 107 is retracted to the side of the door 101 (the right side of FIGS. 11A to 11D) more than the conveying guide surface 106*f* of the conveying guide plate 106. Then, the sheet S is slipped. Alternatively, since wrinkling or sagging of the sheet S occurs, the sheet S may not be normally conveyed.

Accordingly, the maximum clearance dimension of the follower roller 107 is at least set such that the outer circumferential surface of the follower roller 107 is set to the side of the conveying roller 142 (the left side of FIGS. 11A to 11D) than the conveying guide surface 106*f* of the conveying guide plate 106.

In the above-described configuration, the movement operation in the pressurizing direction of the coil spring 148 of the bearing 137 pressurized by the coil spring 136 by the restoring force of the wire spring 135 is smoothly performed.

Thus, a stepped difference between the outer diameter of the follower roller 107 and the bearing 137 can be determined such that the sheet S at least does not interfere with the bearing 137 and the follower roller 107 can be reliably maintained by space-saving.

The hook portions 135*a* of the wire spring 135 are mounted and detached from the notches 132*h* and 132*i* of the bearing guides 132*f* and 132*g* provided in the stay 132. Thus, since the wire spring 135, the bearing 137, the follower roller 107, and the coil spring 136 can be easily mounted and detached, assembly and disassembly becomes easy at the time of manufacturing a product, maintenance, and repair service. Therefore, workability is improved.

Second Embodiment

Next, the configurations of a sheet conveying apparatus and an image forming apparatus including the sheet conveying apparatus according to a second embodiment of the invention will be described with reference to FIGS. 12A to 12C. The same reference numerals are given to the same constituent elements as those of the above-described first embodiment, and the description thereof will not be repeated.

Figure 12A:
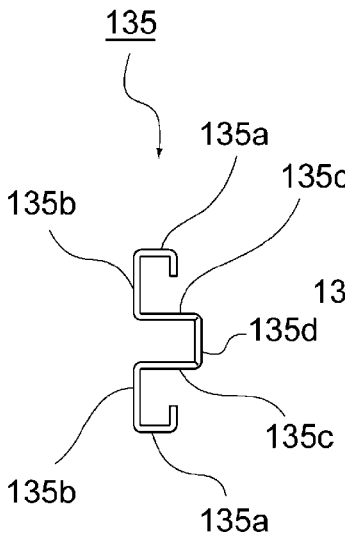
FIG. 12A is a plan view illustrating the configuration of a wire spring in a sheet conveying apparatus according to a second embodiment of the invention.
Figure 12B:
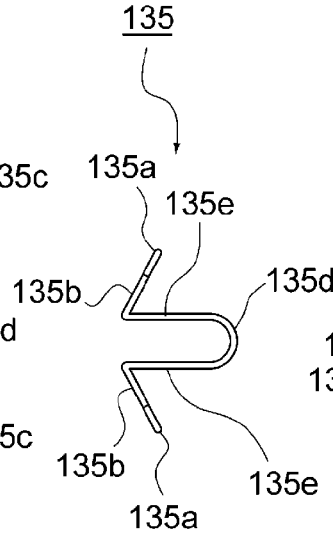
FIG. 12B is a side view illustrating the configuration of the wire spring in the sheet conveying apparatus according to the second embodiment of the invention.
Figure 12C:
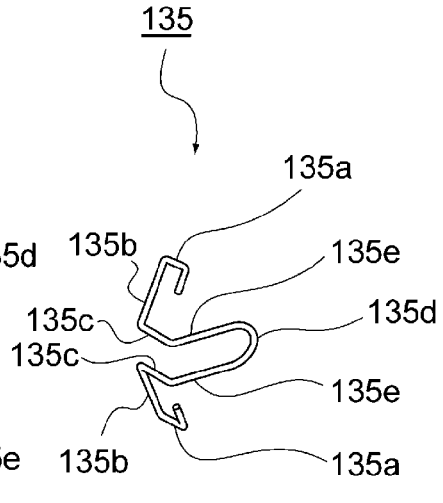
FIG. 12C is a perspective view illustrating the configuration of the wire spring in the sheet conveying apparatus according to the second embodiment of the invention.

FIGS. 12A to 12C are plan, side, and perspective views illustrating another shape of the wire spring 135. In this embodiment, the wire spring 135 is used which includes flexible arm portions 135*e* longer by a predetermined length than the flexible arm portions 135*e* of the wire spring 135 according to the first embodiment described above with reference to FIGS. 9A to 9C.

When the maximum amount of displacement of the bearing 137 increases or the sheet conveying speed is required to be faster, the pressurizing force of the coil spring 136 increases in some cases. In this case, it is necessary to appropriately modify the spring shape of the wire spring 135 to meet the demand.

In FIGS. 12A to 12C, the flexible arm portions 135*e* of the wire spring 135 are lengthened. As described above in FIG. 11C, the flexible arm portions 135*e* of the wire spring 135 pressed by the pressing portions 135*c* abutted to the arc-shaped spring reception surface 137*a* of the bearing 137 pushed by the pressurizing force of the coil spring 148 are stretched in conjunction with the flexible portions 135*d*, and thus an open angle is formed.

In this embodiment, as illustrated in FIGS. 12A to 12C, when the same pressure is applied from the wire spring 135 according to the first embodiment described in FIGS. 9A to 9C, an open angle of one pair of flexible arm portions 135*e* centering on the flexible portion 135*d* are further widened to the degree of the flexible arm portions 135*e*. Thus, the position of the bearing 137 can be further moved to the side of the conveying roller 142 (the left side of FIGS. 11A to 11D).

The bearing 137 is pressurized to the left direction of FIG. 11B by the coil spring 136, and thus the follower roller 107 is pushed to the right direction of FIG. 11B by the force of the body of the conveyed sheet S. Thus, in regard to the change in the position of the bearing 137, the direction of applying a force to the bearing 137 by the restoring force of the wire spring 135 faces the pressurization direction of the coil spring 136 at a predetermined inclination angle of the upper and lower sides. Thus, it is difficult to obtain the nipping force and the resistance of the sheet S by the conveying roller 142 and the follower roller 107. Therefore, it is necessary to reduce the influence of the restoring force of the wire spring 135 within a use range at the time of conveying the sheet.

In this embodiment, the open angle of one pair of flexible arm portions 135*e* centering on the flexible portion 135*d* of the wire spring 135 can be widened. Thus, when the change in the position of the bearing 137 in the pressurization direction of the bearing 137 by the coil spring 136 is large, the influence of the restoring force of the wire spring 135 can be reduced and the following range of the bearing 137 can be expanded. Since the other configuration is the same as the configuration of the first embodiment, it is possible to obtain the same advantages.

Third Embodiment

Next, the configurations of a sheet conveying apparatus and an image forming apparatus including the sheet conveying apparatus according to a third embodiment of the invention will be described with reference to FIGS. 13A to 13C. The same reference numerals are given to the same constituent elements as those of each embodiment described above, and the description thereof will not be repeated.

Figure 13A:
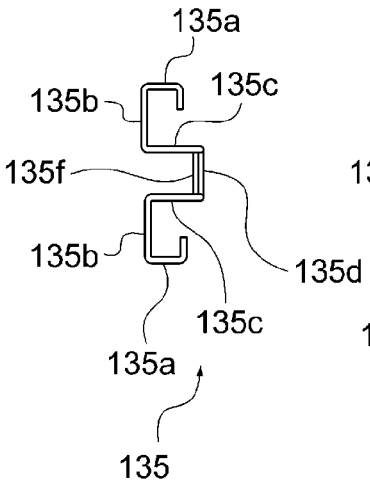
FIG. 13A is a plan view illustrating the configuration of a wire spring in a sheet conveying apparatus according to a third embodiment of the invention.
Figure 13B:
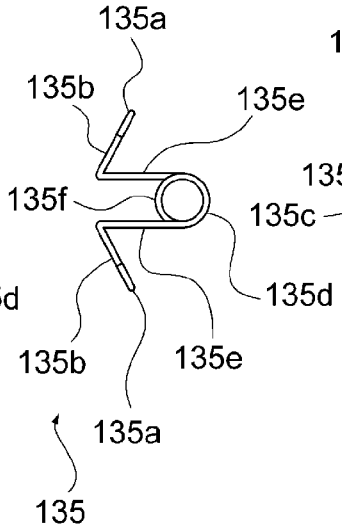
FIG. 13B is a side view illustrating the configuration of the wire spring in the sheet conveying apparatus according to the third embodiment of the invention.
Figure 13C:
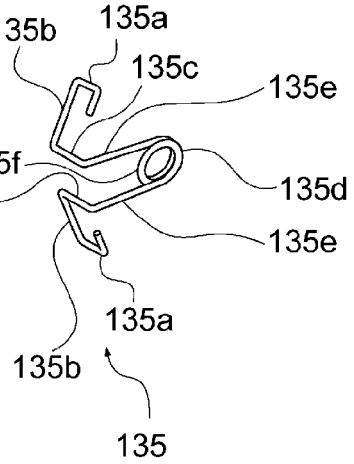
FIG. 13C is a perspective view illustrating the configuration of the wire spring in the sheet conveying apparatus according to the third embodiment of the invention.

FIGS. 13A to 13C are plan, side, and perspective views illustrating still another shape of the wire spring 135. In this embodiment, a torsion coil spring portion 135*f* which is a circular coil portion is formed in the flexible arm portions 135*e* of the wire spring 135 of the second embodiment described above with reference to FIGS. 12A to 12C to configure the flexible portion 135*d*.

By forming the torsion coil spring portion 135*f* in the flexible portions 135*d*, the line length of the wire spring 135 is lengthened, and thus both a torsion force and a flexible force generated by the torsion coil spring portion 135*f* are combined.

Thus, the numerical value of the spring constant of the wire spring 135 can be further reduced. Therefore, in the movement of the bearing 137 in the pressurization direction by the coil spring 136, the spring pressure applied to the spring reception surface 137*a* of the bearing 137 can be set to be closer in the pressurization direction by the coil spring 136.

Accordingly, the restoring force of the wire spring 135 for the high-speed change in the sheet conveying speed at the time of conveying the sheet can be set to be closer in the pressurization direction by the coil spring 136, and thus followability of the bearing 137 for the change in the position of the bearing 137 can be improved. Further, the durability of the wire spring 135 can be lengthened.

The optimum shape of the wire spring 135 can be selected so as to be suitable for all of the conditions such as the position condition of the used follower roller 107, the pressurizing force of the coil spring 136, and a dimensional tolerance. Since the other configuration is the same as the configuration of each embodiment described above, it is possible to obtain the same advantages.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-101865, filed Apr. 26, 2012, which is hereby incorporated by reference herein in its entirety.

What is claimed is:

1. A sheet conveying apparatus comprising:

a pair of conveying rotating members that includes a first rotating member and a second rotating member and nips a sheet between the first rotating member and the second rotating member;

a bearing that supports the second rotating member to be rotatable;

a biasing portion that biases the bearing toward the first rotating member with a biasing force of the biasing portion to press the second rotating member to the first rotating member; and a wire spring that includes both ends locked to locking portions and a middle abutted to the bearing and holds the bearing against the biasing force of the biasing portion.

2. The sheet conveying apparatus according to claim 1, further comprising:

a bearing guide that guides the bearing in a biasing direction of the biasing portion, wherein in correspondence with a change in a position of the bearing moved by the bearing guide, the wire spring follows the bearing by an elastic force of the wire spring.

3. The sheet conveying apparatus according to claim 1, wherein the wire spring includes two pressing portions that are provided in the middle and are abutted to the bearing, and a flexible portion that is provided between the two pressing portions and are deformed so that the two pressing portions of the wire spring follow the bearing while being abutted to the bearing in correspondence with a change in a position of the bearing.

4. The sheet conveying apparatus according to claim 1, wherein the wire spring includes hook portions that are provided at both ends of the wire spring and are locked to the locking portions, hook arm portions that are connected to the hook portions, pressing portions that are connected to the hook arm portions and are abutted to the bearing, flexible arm portions that are connected to the pressing portions, face an end surface of the bearing in an axial direction, and are able to restrain the bearing in the axial direction, and a flexible portion that is connected to the flexible arm portions and has a U shape or a circular shape.

5. The sheet conveying apparatus according to claim 1, wherein the first rotating member is provided in an apparatus body, and wherein the second rotating member is provided in a door configured to be opened and closed with respect to the apparatus body.

6. The sheet conveying apparatus according to claim 5, wherein the door includes:

a conveying guide that guides a sheet, and a hole that is formed within a sheet conveying width of the conveying guide in which the sheet is conveyed, wherein the bearing, the second rotating member, and the biasing portion are detachable from the door through the hole by taking off the wire spring from the locking portions in a state that the door is opened with respect to the apparatus body.

7. The sheet conveying apparatus according to claim 5, wherein the door includes a conveying guide that guides a sheet, and a hole that is formed within a sheet conveying width of the conveying guide in which the sheet is conveyed, wherein the second rotating member is detachable from the door through the hole by taking off the wire spring from the locking portions in a state that the door is opened with respect to the apparatus body.

8. An image forming apparatus comprising:

a sheet conveying apparatus according to claim 1; and an image forming portion that forms an image on a sheet based on image information.

9. A sheet conveying apparatus comprising:

an apparatus body;

a first rotating member that is provided on the apparatus body and conveys a sheet;

a door that is configured to be opened and closed with respect to the apparatus body, a second rotating member that is provided on the apparatus body and is abutted to the first rotating member a biasing portion that is provided on the door and applies a force to bias the second rotating member toward the first rotating member; and a wire spring having both ends locked to the door and receiving the force applied by the biasing portion at least when the door is opened with respect the apparatus body.

10. The sheet conveying apparatus according to claim 9, wherein the wire spring includes a flexible portion with a U shape or a circular shape.

11. The sheet conveying apparatus according to claim 9, wherein the wire spring includes two pressing portions that are abutted to the bearing, and a flexible portion that is provided between the two pressing portions of the wire spring.

12. The sheet conveying apparatus according to claim 9, wherein the door includes:

a conveying guide that guides a conveyed sheet, and a hole that is formed on the conveying guide and in which the second rotating member is mounted, the second rotating member being detachable from the door through the hole by taking off the wire spring from the door in a state that the door is opened with respect to the apparatus body.

13. The sheet conveying apparatus according to claim 12, further comprising;

a bearing that supports the second rotating member to be rotatable, wherein the hole is formed within a sheet conveying width in which the sheet is conveyed, and the wire spring, the bearing, the second rotating member, and the biasing portion can be detached from the door through the hole.

14. A sheet conveying apparatus comprising:

a first rotating member;

a second rotating member that is pressed to the first rotating member and rotates in a following manner;

a bearing that supports the second rotating member to be rotatable and is provided to be movable;

a first pressing unit that applies a pressing force to the bearing to press the second rotating member to the first rotating member; and a second pressing unit that applies a force to the bearing to hold the bearing against the pressing force of the first pressing unit.

15. The sheet conveying apparatus according to claim 14, further comprising:

a bearing guide that guides the bearing to be movable in a pressing direction of the pressing portion, wherein in correspondence with a change in a position of the bearing moved by the bearing guide, the second pressing unit follows the bearing by the force of the second pressing unit.

16. The sheet conveying apparatus according to claim 14, wherein the first rotating member is provided in an apparatus body, wherein the second rotating member is provided in a door configured to be opened and closed with respect to the apparatus body.

17. The sheet conveying apparatus according to claim 14, further comprising:

a door configured to be opened and closed with respect to an apparatus body and to hold second rotating member, wherein the door includes:

a conveying guide that guides a sheet, and a hole that is formed within a sheet conveying width of the conveying guide in which the sheet is conveyed, wherein the second rotating member is detachable from the door through the hole by taking off the second pressing unit from the door in a state that the door is opened with respect to the apparatus body.

* * * * *